US010995583B1

(12) United States Patent
Helms et al.

(10) Patent No.: US 10,995,583 B1
(45) Date of Patent: May 4, 2021

(54) BUOYANCY ASSIST TOOL WITH DEBRIS BARRIER

(71) Applicant: Halliburton Energy Services, Inc., Houston, TX (US)

(72) Inventors: Lonnie Carl Helms, Humble, TX (US); Min Mark Yuan, Katy, TX (US); Mayur Narain Ahuja, Friendswood, TX (US); Ishwar Dilip Patil, Spring, TX (US); Rajesh Parameshwaraiah, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/670,567

(22) Filed: Oct. 31, 2019

(51) Int. Cl.

| | |
|---|---|
| ***E21B 34/06*** | (2006.01) |
| ***E21B 33/12*** | (2006.01) |
| ***E21B 43/10*** | (2006.01) |
| ***E21B 34/14*** | (2006.01) |
| ***E21B 17/01*** | (2006.01) |
| ***E21B 7/128*** | (2006.01) |
| ***E21B 19/09*** | (2006.01) |
| ***E21B 33/04*** | (2006.01) |

(52) U.S. Cl.
CPC ..... *E21B 34/063* (2013.01); *E21B 33/1208* (2013.01)

(58) Field of Classification Search
CPC .... E21B 43/10; E21B 34/063; E21B 33/1208; E21B 34/06; E21B 34/14; E21B 17/012; E21B 17/015; E21B 7/128; E21B 19/09; E21B 33/0415
See application file for complete search history.

(56) References Cited

U.S. PATENT DOCUMENTS

| | | | | |
|---|---|---|---|---|
| 3,463,351 | A * | 8/1969 | Mills | F16K 17/162 220/89.2 |
| 3,779,263 | A | 12/1973 | Edwards et al. | |
| 3,980,134 | A | 9/1976 | Amancharla | |
| 4,457,376 | A | 7/1984 | Carmody et al. | |
| 5,150,756 | A | 9/1992 | Hassanzadeh | |
| 5,479,986 | A | 1/1996 | Gano et al. | |
| 5,765,641 | A | 6/1998 | Shy et al. | |

(Continued)

FOREIGN PATENT DOCUMENTS

| | | |
|---|---|---|
| EP | 0681087 B1 | 9/2000 |
| JP | 6551001 B2 | 7/2019 |

(Continued)

OTHER PUBLICATIONS

International Search Report and Written Opinion dated Aug. 14, 2018, issued in PCT Application No. PCT/US2017/062528.

(Continued)

*Primary Examiner* — Tara Schimpf
*Assistant Examiner* — Manuel C Portocarrero
(74) *Attorney, Agent, or Firm* — McAfee & Taft

(57) ABSTRACT

A downhole apparatus comprises a casing string with a removable plug therein to block flow therethrough. A flow barrier is positioned in the casing below the removable plug and the removable plug and the flow barrier defining a buoyancy chamber therebetween. A debris barrier positioned above the removable plug includes a frangible disk. A stretchable connecting ring is connected to the frangible disk and to the casing.

19 Claims, 7 Drawing Sheets

(56) References Cited

U.S. PATENT DOCUMENTS

| | | | |
|---|---|---|---|
| 6,026,903 | A | 2/2000 | Shy et al. |
| 6,076,600 | A | 6/2000 | Vick, Jr. et al. |
| 6,161,622 | A | 12/2000 | Robb et al. |
| 6,324,904 | B1 | 12/2001 | Ishikawa et al. |
| 6,450,263 | B1 | 9/2002 | Schwendemann |
| 6,505,685 | B1 | 1/2003 | Sullaway et al. |
| 6,622,798 | B1 | 9/2003 | Rogers et al. |
| 6,651,748 | B2 | 11/2003 | Sullaway et al. |
| 6,672,389 | B1 | 1/2004 | Hinrichs |
| 6,758,281 | B2 | 7/2004 | Sullaway et al. |
| 7,270,191 | B2 | 9/2007 | Drummond et al. |
| 8,505,621 | B2 | 8/2013 | Telfer et al. |
| 9,309,752 | B2 | 4/2016 | Talley et al. |
| 9,441,437 | B2 | 9/2016 | Fripp et al. |
| 9,441,446 | B2 | 9/2016 | Fripp et al. |
| 9,518,445 | B2 | 12/2016 | Noske |
| 9,540,904 | B2 | 1/2017 | Petrowsky |
| 9,593,542 | B2 | 3/2017 | Getzlaf et al. |
| 10,138,707 | B2 | 11/2018 | Tolman et al. |
| 2002/0185273 | A1 | 12/2002 | Aronstam et al. |
| 2003/0116324 | A1 | 6/2003 | Dawson et al. |
| 2003/0217844 | A1* | 11/2003 | Moyes ..... B21D 39/203 166/118 |
| 2008/0073075 | A1 | 3/2008 | Buyers et al. |
| 2008/0115942 | A1 | 5/2008 | Keller et al. |
| 2010/0270031 | A1 | 10/2010 | Patel |
| 2010/0294376 | A1 | 11/2010 | O'Brien et al. |
| 2011/0042099 | A1 | 2/2011 | Williamson, Jr. et al. |
| 2011/0253392 | A1 | 10/2011 | May et al. |
| 2012/0111566 | A1 | 5/2012 | Sherman et al. |
| 2014/0174757 | A1 | 6/2014 | Fripp et al. |
| 2014/0216756 | A1 | 8/2014 | Getzlaf et al. |
| 2014/0224505 | A1 | 8/2014 | Ramon |
| 2014/0338923 | A1 | 11/2014 | Fripp et al. |
| 2015/0107843 | A1 | 4/2015 | Talley et al. |
| 2015/0129205 | A1 | 5/2015 | Hofman et al. |
| 2015/0240596 | A1 | 8/2015 | Horwell |
| 2016/0177668 | A1 | 6/2016 | Watson et al. |
| 2016/0333658 | A1 | 11/2016 | Keshishian et al. |
| 2017/0096875 | A1 | 4/2017 | Ravensbergen et al. |
| 2017/0138153 | A1 | 5/2017 | Getzlaf et al. |
| 2018/0003004 | A1 | 1/2018 | Norman et al. |
| 2018/0058179 | A1 | 3/2018 | Nuryaningsih et al. |
| 2018/0080308 | A1 | 3/2018 | Dedman et al. |
| 2018/0219200 | A1 | 8/2018 | Albukrek et al. |
| 2018/0262127 | A1 | 9/2018 | Gooneratne et al. |
| 2018/0371869 | A1 | 12/2018 | Kellner et al. |
| 2019/0352994 | A1 | 11/2019 | Giroux |
| 2019/0352995 | A1 | 11/2019 | Giroux et al. |

FOREIGN PATENT DOCUMENTS

| | | | |
|---|---|---|---|
| WO | 2015073001 | A1 | 5/2015 |
| WO | 2016176643 | A1 | 11/2016 |
| WO | 2019099046 | A1 | 5/2019 |

OTHER PUBLICATIONS

International Search Report and Written Opinion dated Sep. 19, 2019, issued in PCT Application No. PCT/US2018/066889.

International Search Report and Written Opinion dated Sep. 19, 2019, issued in PCT Application No. PCT/US2018/067161.

International Search Report and Written Opinion dated Aug. 14, 2019, issued in PCT Application No. PCT/US2019/064051.

International Search Report and Written Opinion dated Jan. 14, 2020, issued in PCT Application No. PCT/US2019/027502.

International Search Report and Written Opinion dated Feb. 5, 2020, issued in PCT Application No. PCT/US2019/0031541.

International Search Report and Written Opinion dated Jan. 21, 2020, issued in PCT Application No. PCT/US2019/028508.

International Search Report and Written Opinion dated May 25, 2020, issued in PCT Application No. PCT/US2019/056206.

International Search Report and Written Opinion dated May 26, 2020, issued in PCT Application No. PCT/US2019/059757.

International Search Report and Written Opinion dated Jan. 16, 2020, issued in PCT Application No. PCT/US2019/027625.

International Search Report and Written Opinion dated Jul. 21, 2020, issued in PCT Application No. PCT/US2019/059864.

International Search Report and Written Opinion dated Jul. 23, 2020, issued in PCT Application No. PCT/US2019/061714.

International Search Report and Written Opinion dated Aug. 11, 2020, issued in PCT Application No. PCT/US2019/065862.

International Search Report and Written Opinion dated Aug. 31, 2020, issued in PCT Application No. PCT/US2020/012307.

International Search Report and Written Opinion dated Oct. 27, 2020, in PCT Application No. PCT/US2020/039399.

* cited by examiner

BUOYANCY ASSIST TOOL WITH DEBRIS BARRIER

The length of deviated or horizontal sections in wellbores is such that it is sometimes difficult to run well casing to the desired depth due to high casing drag. Long lengths of casing create significant friction and thus problems in getting casing to the toe of the wellbore. Creating a buoyant chamber in the casing utilizing air or a fluid lighter than the wellbore fluid can reduce the drag making it easier to overcome the friction and run the casing to the desired final depth.

DESCRIPTION OF THE DRAWINGS

FIG. 6 is a cross section of an additional embodiment of a buoyancy assist tool of the current disclosure.

FIG. 8 is an enlarged view of the debris barrier of FIG. 6.

FIG. 9 is an enlarged view of the connection for the connecting ring and disk of the debris barrier of FIG. 6.

DESCRIPTION

Figure 1:
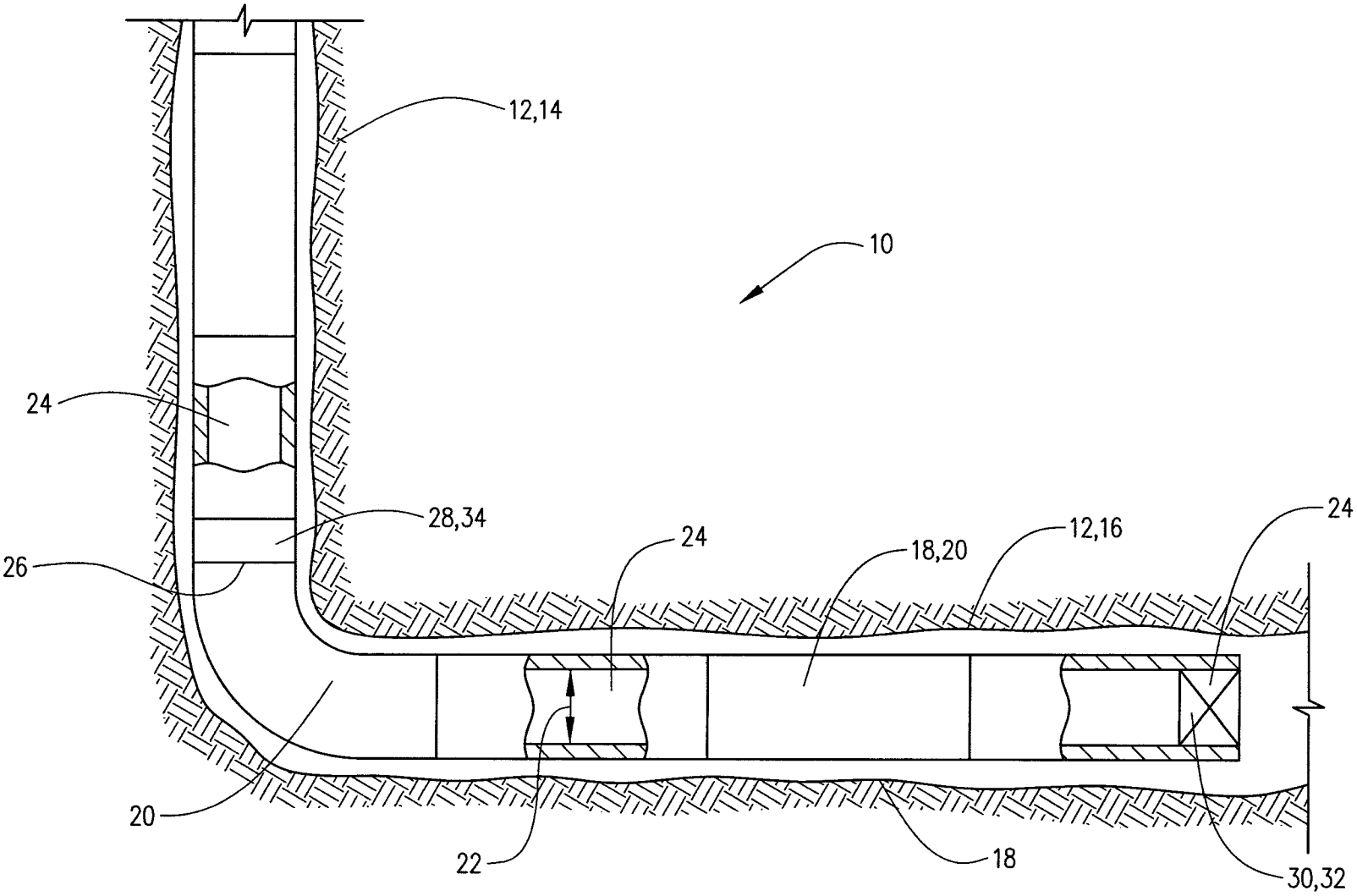
FIG. 1 is a schematic view of an exemplary wellbore with a well casing including a buoyancy chamber therein.
Figure 2:
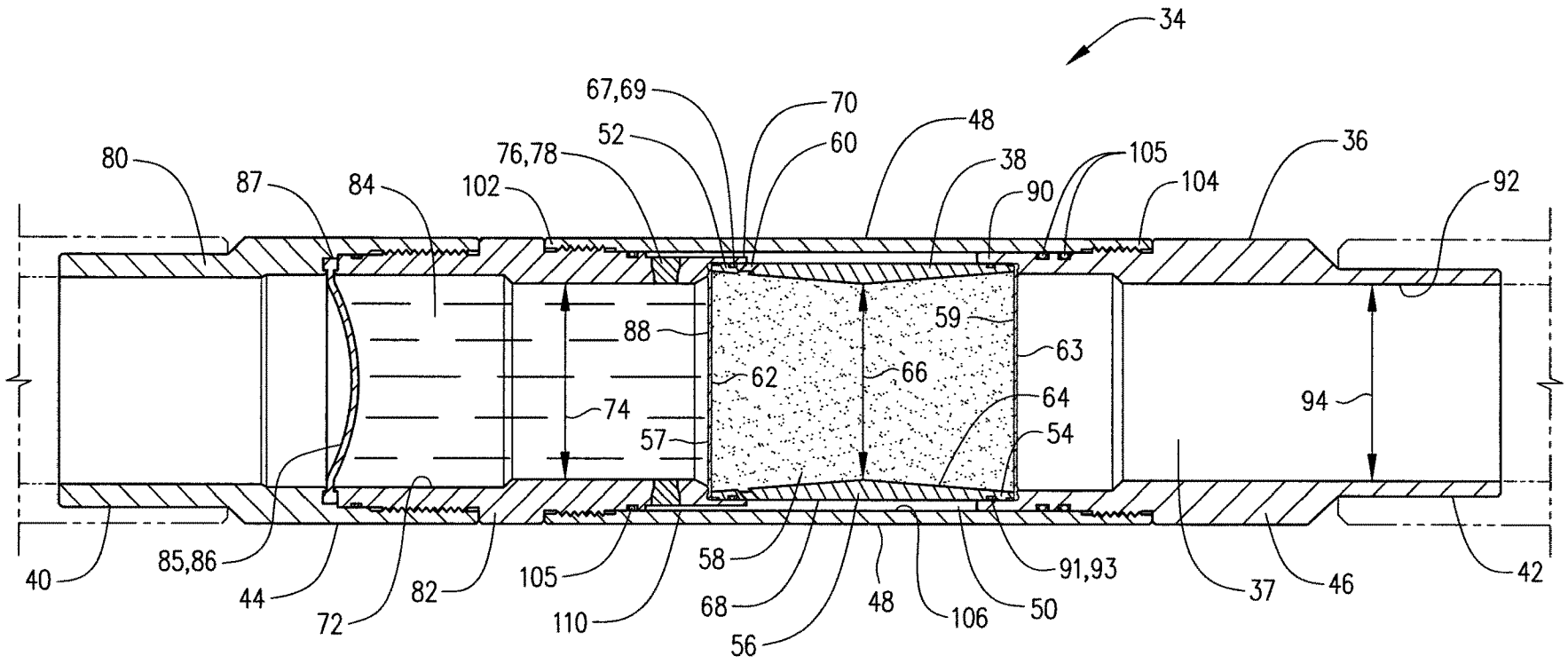
FIG. 2 is a cross section of a buoyancy assist tool of the current disclosure.
Figure 3:
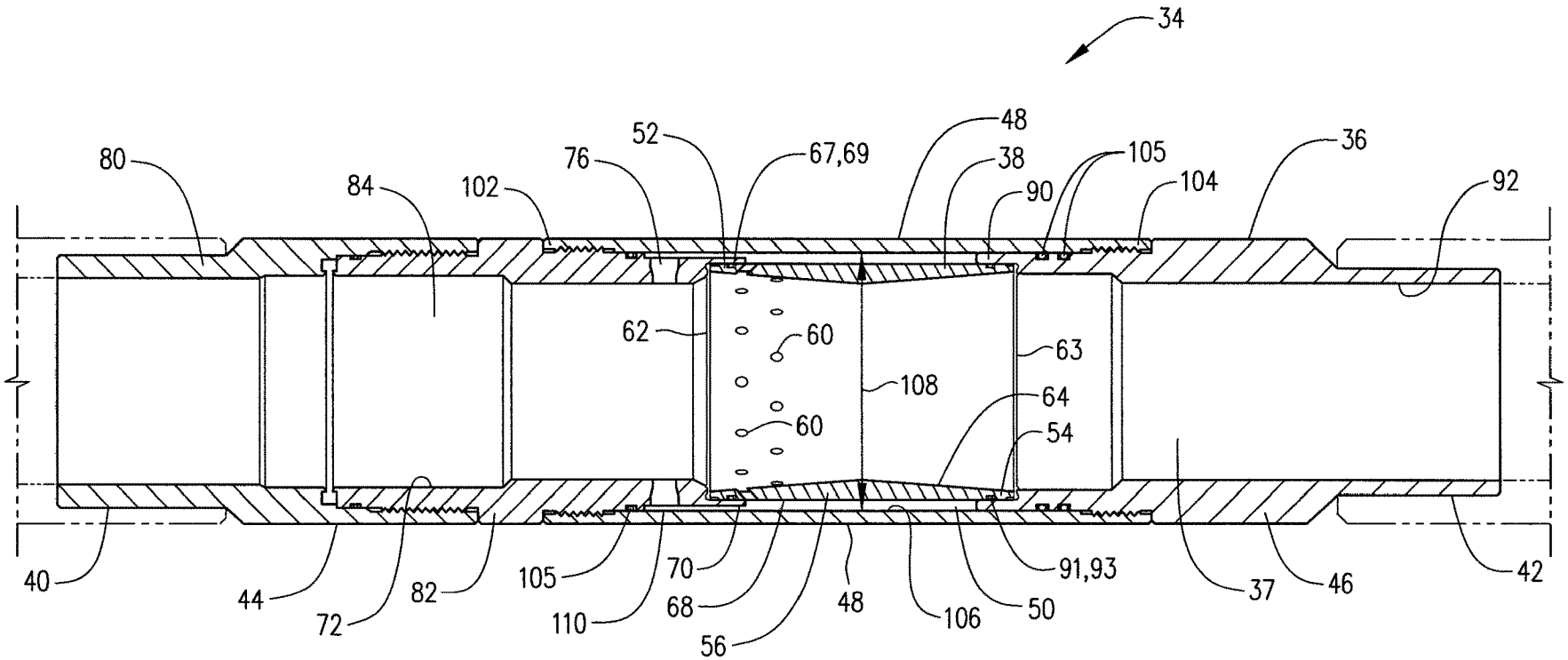
FIG. 3 is a cross section of a buoyancy assist tool of FIG. 2 after the plug has degraded and the plug and debris barrier removed from the buoyancy assist tool.
Figure 4:
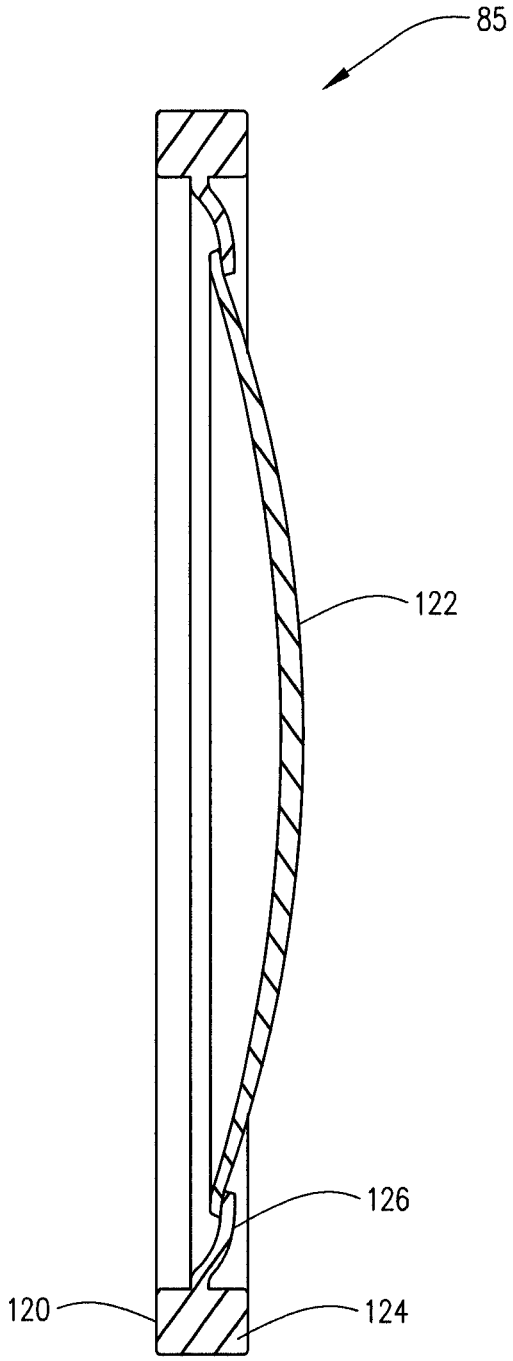
FIG. 4 is an enlarged view of the debris barrier.
Figure 5:
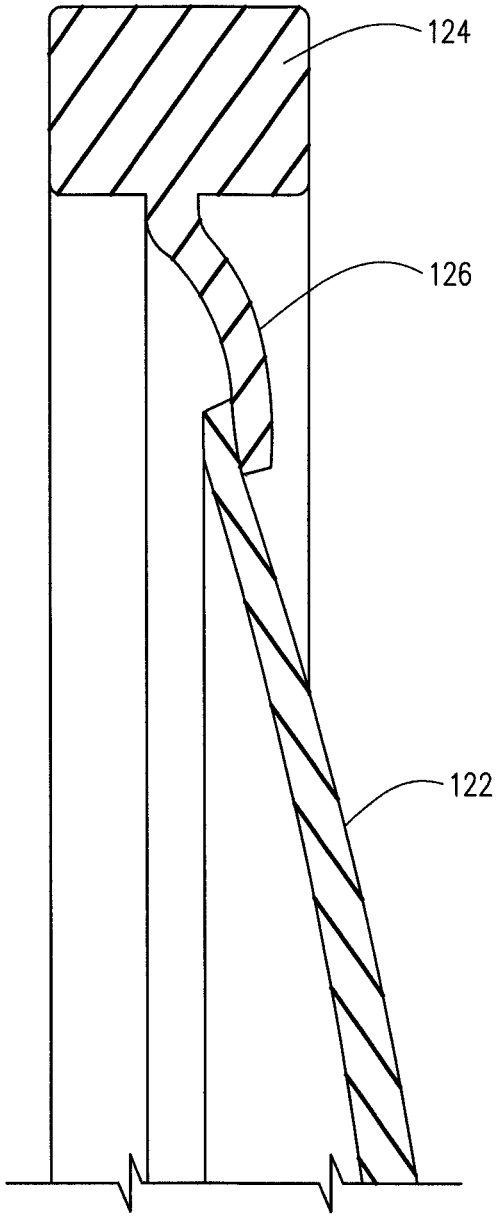
FIG. 5 is an enlarged view of the connection for the connecting ring and disk of the debris barrier.
Figure 5:
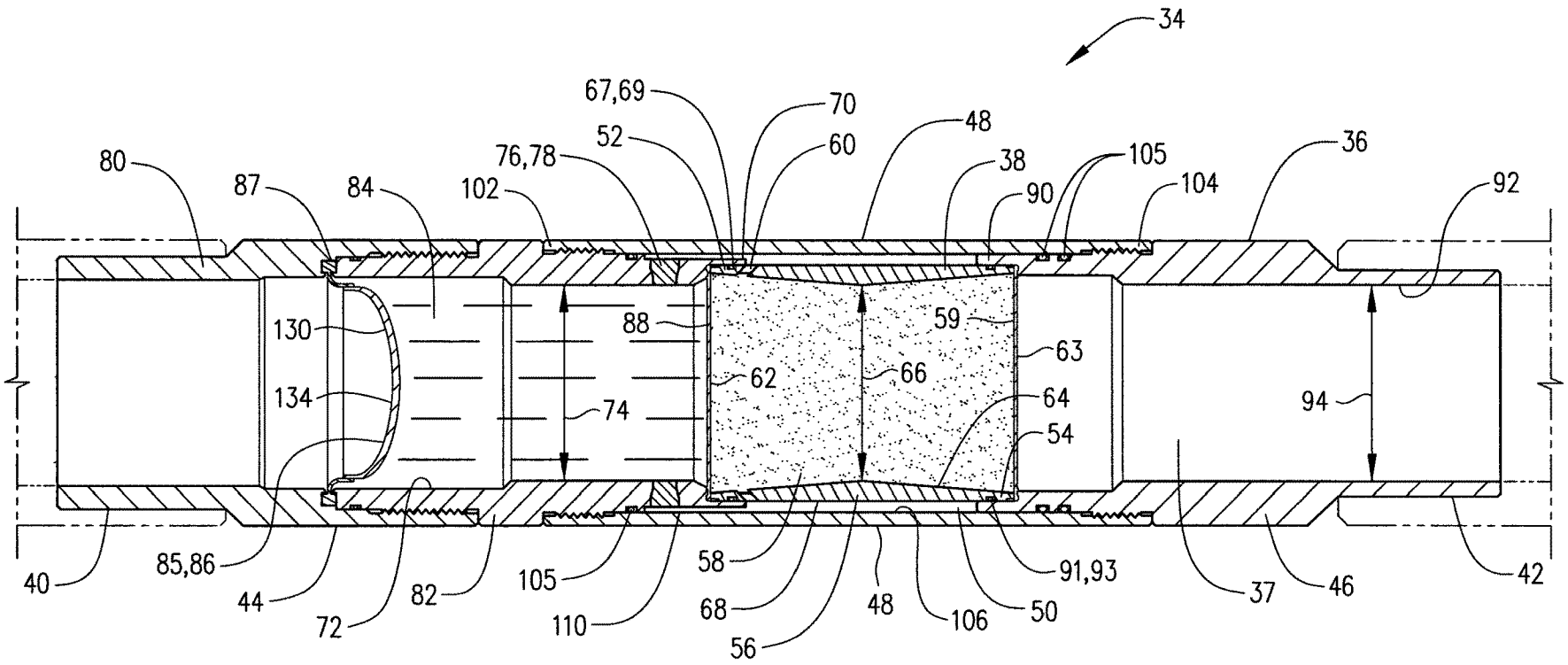
Figure 7:
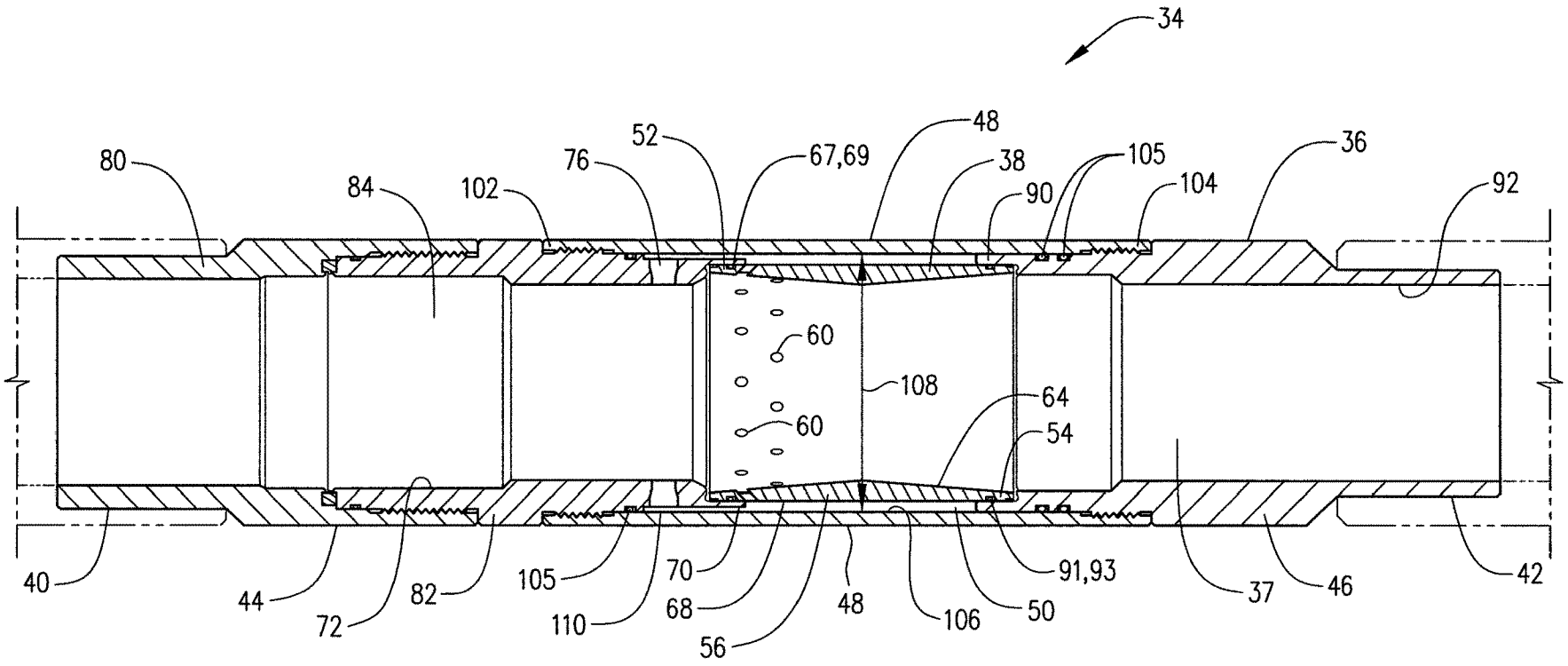
FIG. 7 is a cross section of a buoyancy assist tool of FIG. 6 after the plug has degraded and the plug and debris barrier removed from the buoyancy assist tool.
Figure 5:
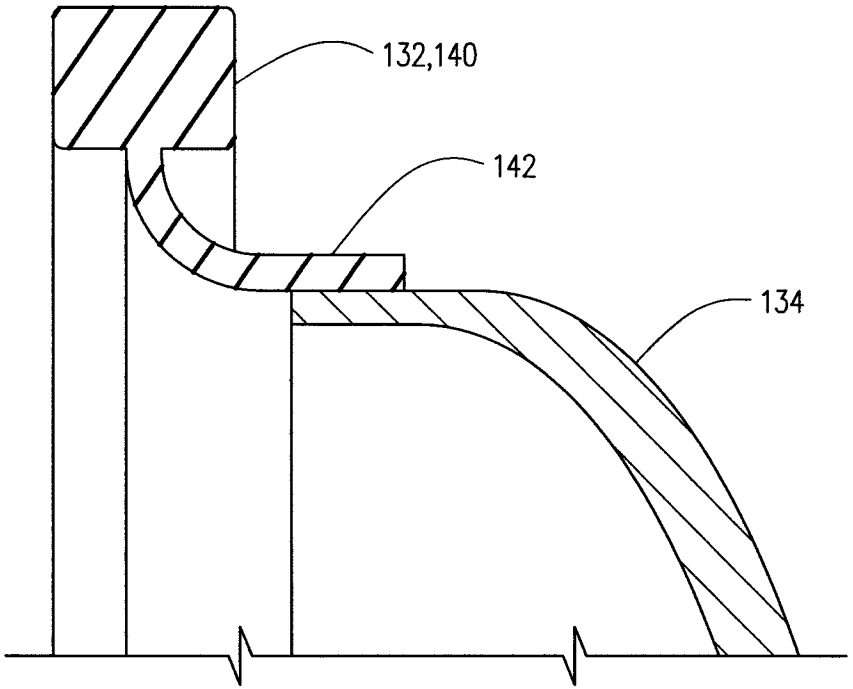
Figure 4:
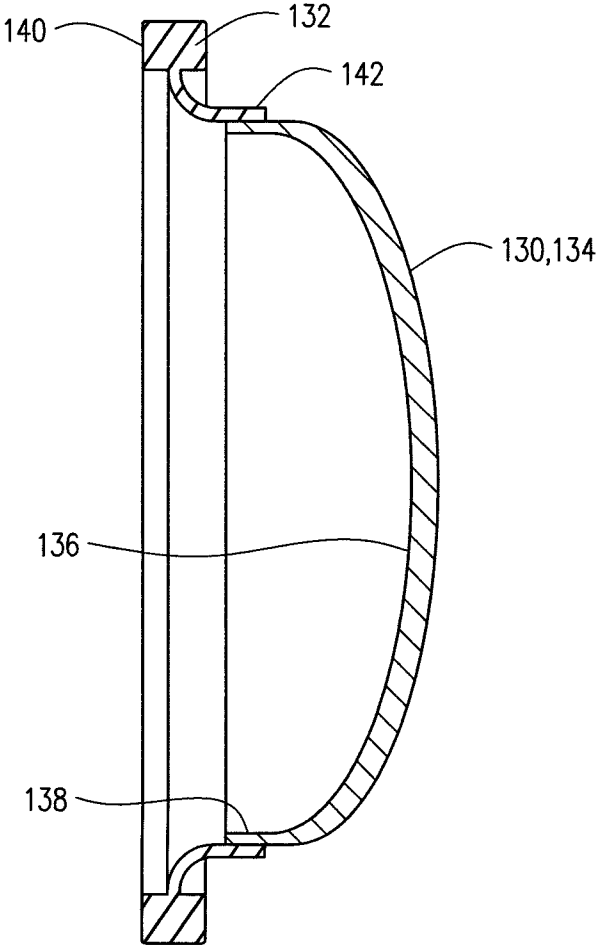

The following description and directional terms such as above, below, upper, lower, uphole, downhole, etc., are used for convenience in referring to the accompanying drawings. One who is skilled in the art will recognize that such directional language refers to locations in the well, either closer or farther from the wellhead and the various embodiments of the inventions described and disclosed here may be utilized in various orientations such as inclined, deviated, horizontal and vertical.

Referring to the drawings, a downhole apparatus 10 is positioned in a wellbore 12. Wellbore 12 includes a vertical portion 14 and a deviated or horizontal portion 16. Apparatus 10 comprises a casing string 18 which is made up of a plurality of casing joints 20. Casing joints 20 may have inner diameter or bore 22 which defines a central flow path 24 therethrough. Well casing 18 defines a buoyancy chamber 26 with upper end or boundary 28 and lower end or boundary 30. Buoyancy chamber 26 will be filled with a buoyant fluid which may be a gas such as nitrogen, carbon dioxide, or air but other gases may also be suitable. The buoyant fluid may also be a liquid such as water or diesel fuel or other like liquid. The important aspect is that the buoyant fluid has a lower specific gravity than the well fluid in the wellbore 12 in which casing 18 is run. The choice of gas or liquid, and which one of these is used is a factor of the well conditions and the amount of buoyancy desired.

Lower boundary 30 may comprise a float device such as a float shoe or float collar 32. As is known, such float devices will generally allow fluid flow downwardly therethrough but will prevent flow upwardly into the casing. The float devices are generally one-way check valves. The float device 32 is thus a fluid barrier that will be configured such that it will hold the buoyant fluid in the buoyancy chamber 26 until additional pressure is applied after the release of the buoyancy fluid from the buoyancy chamber. The upper boundary 28 is defined by a buoyancy assist tool as described herein.

Buoyancy assist tool 34 includes an outer case 36 defining flow path 37 therethrough that is connectable in casing string 18. Buoyancy assist tool 34 comprises a plug assembly 38 that is connected to and positioned in outer case 36. Buoyancy assist tool 34 has upper end 40 and lower end 42. Buoyancy assist tool 34 is connectable in the casing string at the upper and lower ends 40 and 42 thereof and forms a part of the casing string 18 lowered into wellbore 12.

Outer case 36 comprises an upper outer case 44 and a lower outer case 46. A connecting shield 48 is connected to and extends-between upper outer case 44 and lower outer case 46. Outer case 36 and plug assembly 38 define an annular space 50 therebetween.

Plug assembly 38 has upper end 52 and lower end 54. Plug assembly 38 is connected to upper outer case 44 at the upper end 52 thereof and to lower outer case 46 at the lower end 54 thereof. The plug assembly may be threadedly connected or connected by other means known in the art. Plug assembly 38 may comprise a plug housing 56 with upper and lower ends 52 and 54 which are the upper and lower ends of the plug assembly 38. A degradable plug or degradable core 58 is fixed in housing 56. Degradable core 58 has upper end 57 and lower end 59, which may be for example coincident with the upper and lower ends 52 and 54 of plug housing 56. The degradable core may be a matrix of sand and salt but can be other degradable substances that can be degraded with fluids or other means once the casing string 18 is lowered into the wellbore to a desired location in the well. Plug housing 56 has a plurality of housing ports 60 defined through the wall thereof. Housing ports 60 communicate the annular space 50 with the degradable plug or core 58 so that fluid passing therethrough can contact degradable plug 58 and can degrade the plug to remove it from plug housing 56 to create a full bore flow path therethrough.

Buoyancy assist tool 34 may include an upper impermeable membrane 62 positioned across upper end 57 of degradable plug 58 and a lower impermeable membrane 63 positioned across the lower end 59 of degradable plug 58. Membranes 62 and 63 will prevent fluid thereabove from contacting the degradable plug at the upper end of the plug assembly 38 prior to the time casing string 18 is placed at the desired location in wellbore 12. Likewise, the impermeable membrane 63 will prevent fluid in the buoyancy chamber 26 from contacting the degradable plug 58 until such time as degradation of the plug is desired. Upon degradation of the plug 58 the membranes 62 and 63 will be easily ruptured by fluid flowing through the casing string 18, including outer case 36.

Plug housing 56 has an inner surface 64 defining a diameter 66 and has an outer surface 68. In the embodiment described diameter 66 is a diameter that is no smaller than an inner diameter of casing string 18 such that upon the degradation of plug 58 buoyancy assist tool 34 provides no greater restriction to the passage of well tools therethrough than that which already exists as a result of the inner diameter of the casing string 18.

Upper end 40 of buoyancy assist tool 34 is likewise the upper end of upper outer case 44. Upper outer case 44 has a lower end 70. Plug assembly 38 is connected at its upper end 52 to the lower end 70 of upper outer case 44. Outer surface 68 of plug housing 56 may have a groove 67 with an O-ring seal 69 therein to sealingly engage an inner surface of upper outer case 44. Upper outer case 44 has inner surface 72 which defines an inner diameter 74 that is a minimum inner diameter of upper outer case 44. Upper outer case 44 has a port 76 therethrough. Inner diameter 74 is a diameter that is no smaller than an inner diameter of casing string 18 such that upon the degradation of plug 58 buoyancy assist tool 34 provides no greater restriction to the passage of well tools therethrough than that which already exists as a result of the inner diameter of the casing string 18.

A rupture disc or other rupturable membrane 78 is positioned in port 76 in upper outer case 44. Rupture disc 78 will prevent flow through port 76 until a desired or predetermined pressure is reached in casing string 18. Upon reaching the predetermined pressure the rupture disc 78 will rupture and fluid will be communicated from casing string 18 through port 76 into annular space 50. Fluid will pass from annular space 50 through housing ports 60 and will contact the degradable plug 58. The fluid passing therethrough may be referred to as a degrading fluid. The degrading fluid may be any fluid utilized to degrade the degradable plug and may be water or other degrading fluid.

The degrading fluid is in fluid chamber 84, which has upper end 86 and lower end 88. Upper membrane 62 prevents the fluid in fluid chamber 84 from contacting degradable plug 58 prior to the rupturing of rupture disc 78. Upper outer case 44 may be a two-piece outer case comprising an upper portion 80 that is threadedly and sealingly connected to lower portion 82. Lower portion 82 connects to plug assembly 38 as shown in the figures. Upper outer case 44 may define fluid chamber 84 which is a closed fluid chamber 84. Fluid chamber 84 has a debris barrier 85 that extends across upper end 86 thereof. Fluid in fluid chamber 84 is thus trapped between debris barrier 85 and the upper membrane 62. There are certain formations in which it is not desirable to pump water. In those instances oil or another fluid other than water may be utilized to fracture or otherwise treat the formation. Where, for example, water is the degrading fluid, but not the treatment fluid, water will be contained in the fluid chamber 84 such that upon reaching the appropriate position in the well oil or other fluid may be pumped through the casing string 18 so that the water in fluid chamber 84 will contact the degradable plug 58 as further described herein. The water in fluid chamber 84 passes into and from annular space 50 through ports 60 in plug housing plug and will contact the degradable plug 58 until it is degraded or dissolved.

Lower outer case 46 has upper end 90 and a lower end which is the lower end 42 of buoyancy assist tool 34. Upper end 90 of lower outer case 46 is connected to lower end 54 of plug assembly 38. Outer surface 68 of plug housing 56 may have a groove 91 with an O-ring seal 93 therein to sealingly engage lower outer case 46. Lower outer case 46 has inner surface 92 defining an inner diameter 94. Inner diameter 94 is a diameter that is no smaller than an inner diameter of casing string 18 such that upon the degradation of plug 58 buoyancy assist tool 34 provides no greater restriction to the passage of well tools therethrough than that which already exists as a result of the inner diameter of the casing string 18.

Connecting sleeve 48 has upper end 102 and lower end 104. Connecting sleeve 48 is connected at its upper end 102 to an outer surface of upper outer case 44 and is connected at its lower end 104 to an outer surface of lower outer case 46. O-ring seals 105 may be positioned in grooves in the outer surfaces of the upper and lower outer cases 44 and 46 respectively to sealingly engage an inner surface 106 of connecting shield 48. Inner surface 106 of connecting shield 48 defines an inner diameter 108. An annular passageway 110 is defined by and between upper outer case 44 and connecting shield 48. Annular passageway 110 communicates fluid delivered through port 76 into annular space 50. Fluid is communicated through ports 60 so that it will contact degradable plug 58 to dissolve or degrade the plug.

Debris barrier 85 is a multiple-piece debris barrier, and in the embodiment described is a two-piece debris barrier. Debris barrier 85 has a connecting ring 120, which is a flexible connecting ring 120. A frangible disk 122 is connected to flexible connecting ring 120. Frangible disk 122 in the embodiment shown is an upward facing concave frangible disk. Flexible connecting ring 120 is stretchable and will stretch when a downward push is applied to frangible disk 122. Flexible connecting ring 120 comprises an annular ring 124 with a tongue 126 extending radially inwardly therefrom. Tongue 126 is bonded or otherwise connected to frangible disk 122 and annular ring 124 is bonded or otherwise connected to outer case 36. Connecting ring 120 thus connects frangible disk 122 to outer case 36. The connecting ring 120 may be, for example an elastomeric ring and the frangible disk 122 a brittle disk comprised of, for example, a phenolic material, ceramic, tempered glass or other brittle material that will break into small pieces.

In operation casing string 18 is lowered into wellbore 12 to a desired location. Running a casing such as casing 18 in deviated wells and long horizontal wells often results in significantly increased drag forces and may cause a casing string to become stuck before reaching the desired location in the wellbore. For example, when the casing produces more drag forces than the available weight to slide the casing down the well, the casing may become stuck. If too much force is applied to the casing string 18 damage may occur. The buoyancy assist tool 34 as described herein alleviates some of the issues and at the same time provides for a full bore passageway so that other tools or objects such as, for example production packers, perforating guns and service tools may pass therethrough without obstruction after well casing 18 has reached the desired depth. When well casing 18 is lowered into wellbore 12 buoyancy chamber 26 will aid in the proper placement since it will reduce friction as the casing 18 is lowered into horizontal portion 16 to the desired location.

Once the casing string 18 has reached the desired position in the wellbore, pressure is increased and fluid pumped through the casing string 18. The pressure will cause debris barrier 85 to apply a downward pressure to the fluid in chamber 84 until at a predetermined pressure rupture disc 78 bursts. Connecting ring 120 will stretch and the frangible disk 122 will apply downward pressure to the fluid in chamber 84. Once rupture disk 78 busts, degrading fluid from fluid chamber 84 will pass through port 76 into passageway 110 and into annular space 50. Fluid will pass from annular space 50 through ports 60 and will contact the degradable plug 58. A sufficient quantity of the degrading fluid will be utilized to degrade degradable plug 58 so that it will be completely removed from plug housing 56.

Typically, once the degradation process reaches a certain level, the degradable plug 58 will break up, and at that point both of upper and lower membranes 62 and 63 will likewise be broken, and the pieces thereof along with pieces of the degradable plug will pass through casing string 18. The pressure in the casing string 18 will cause the debris barrier 85 to break into small pieces that will pass through the casing string and through the float equipment at the end of the casing string 18. Any large pieces that exist will break when they reach the float equipment into pieces that will pass therethrough.

An additional embodiment of a debris barrier is shown connected in outer case 36 in FIG. 6. Debris barrier 130 comprises connecting ring 132 that is a flexible connecting ring 132. A frangible disk 134 is connected to flexible connecting ring 132. Frangible disk 134 in the embodiment shown is an upward facing concave frangible disk. Frangible disk 134 is deeper than frangible disk 122 and may comprise a dome-shaped frangible disk with a rounded bottom portion 136 and an attachment leg 138 extending therefrom. Flexible connecting ring 132 is stretchable and will stretch when a downward push is applied to frangible disk 134. Flexible connecting ring 132 comprises an annular ring 140 with a tongue 142 extending radially inwardly therefrom. Tongue 142 is bonded or otherwise connected to frangible disk 134 and annular ring 140 is bonded or otherwise connected to outer case 36. Connecting ring 132 thus connects frangible disk 134 to outer case 36. The connecting ring 132 may be, for example an elastomeric ring and the frangible disk 134 a brittle disk comprised of, for example, a phenolic material, ceramic, tempered glass or other brittle material that will break into small pieces.

In operation casing string 18 is lowered into wellbore 12 to a desired location. Running a casing such as casing 18 in deviated wells and long horizontal wells often results in significantly increased drag forces and may cause a casing string to become stuck before reaching the desired location in the wellbore. For example, when the casing produces more drag forces than the available weight to slide the casing down the well, the casing may become stuck. If too much force is applied to the casing string 18 damage may occur. The buoyancy assist tool 34 as described herein alleviates some of the issues and at the same time provides for a full bore passageway so that other tools or objects such as, for example production packers, perforating guns and service tools may pass therethrough without obstruction after well casing 18 has reached the desired depth. When well casing 18 is lowered into wellbore 12 buoyancy chamber 26 will aid in the proper placement since it will reduce friction as the casing 18 is lowered into horizontal portion 16 to the desired location.

Once the casing string 18 has reached the desired position in the wellbore, pressure is increased and fluid pumped through the casing string 18. The pressure will cause debris barrier 130 to apply a downward pressure to the fluid in chamber 84 until at a predetermined pressure rupture disc 78 bursts. Connecting ring 132 will stretch and the frangible disk 134 will apply downward pressure to the fluid in chamber 84. Once rupture disk 78 bursts, degrading fluid from fluid chamber 84 will pass through port 76 into passageway 110 and into annular space 50. Fluid will pass from annular space 50 through ports 60 and will contact the degradable plug 58. A sufficient quantity of the degrading fluid will be utilized to degrade degradable plug 58 so that it will be completely removed from plug housing 56.

As described above, once the degradation process reaches a certain level, the degradable plug 58 will break up, and at that point both of upper and lower membranes 62 and 63 will likewise be broken, and the pieces thereof along with pieces of the degradable plug will pass through casing string 18. The pressure in the casing string 18 will cause the debris barrier 130 to break into small pieces that will pass through the casing string and through the float equipment at the end of the casing string 18. Any large pieces that exist will break when they reach the float equipment into pieces that will pass therethrough.

A downhole apparatus comprises a casing string and a removable plug positioned in the casing string to block flow therethrough. A flow barrier is positioned in the casing below the removable plug, and the removable plug and the flow barrier define a buoyancy chamber therebetween. A debris barrier is positioned above the removable plug. The debris barrier comprises a frangible disk and a stretchable connecting ring connected to the frangible disk and to the casing. The debris barrier and removable plug define a fluid chamber therebetween. In one embodiment the removable plug comprises a degradable plug and the fluid in the fluid chamber is a degrading fluid.

A plug housing is connected in the casing string, and the degradable plug is fixed in the plug housing. A membrane may be positioned across an upper end of the degradable plug. In one embodiment the stretchable ring is an elastomeric ring. The stretchable ring is configured to tear and disconnect the debris barrier from the casing. The frangible disk is configured to break into pieces and pass through the casing upon removal of the removable plug from the casing.

A downhole apparatus comprises an outer case connected at upper and lower ends in a casing string. A degradable plug is positioned in the outer case string and a flow barrier connected in the casing string below the degradable plug. The degradable plug and flow barrier define a buoyancy chamber therebetween. A debris barrier is mounted in the outer case above the degradable plug. The debris barrier comprises a frangible disk and a flexible connecting ring connecting the frangible disk to the outer case. A plug housing is connected in the outer case. The plug housing and the outer case define an annulus therebetween, and a rupture disk is positioned in a port defined in the outer case. The port is positioned to communicate fluid from the fluid chamber into the annulus. The plug housing has openings therethrough to communicate the fluid to the degradable plug.

The flexible outer ring is configured to tear and disconnect the frangible disk from the outer case after the rupture disk ruptures. The frangible disk is configured to break into small fragments after the flexible connecting ring tears away from the outer case. In one embodiment the flexible connecting ring comprises an elastomeric connecting ring. The frangible disk comprises in one embodiment an upward facing concave disk and in one example a dome-shaped frangible disk.

A downhole apparatus comprises a casing string and an outer case connected to and forming a part of the casing string. A plug housing is connected in the outer case and a degradable plug is fixed in the plug housing and positioned to block flow therethrough and to block flow through the outer case. A debris barrier is connected in the casing string above the degradable plug. The debris barrier and degradable plug define a fluid chamber therebetween. The debris barrier comprises a flexible connecting ring and a frangible disk connected to the flexible connecting ring.

A flow barrier may be connected in the casing string below the degradable plug. The degradable plug and flow barrier define a buoyancy chamber therebetween. The flexible connecting ring is configured to tear and disconnect the frangible disk from the outer case as a result of fluid pressure acting on the frangible disk. The outer case has a port communicated with an annulus defined by and between the plug housing and the outer case. The port has a rupture disk therein. The debris barrier is configured to apply downward pressure to the fluid in the fluid chamber to rupture the disk and urge the degrading fluid through the port. The flexible connecting ring comprises in one embodiment an elastomeric connecting ring. The frangible disk is a brittle disk that may comprise, for example, a phenolic disk.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention.

What is claimed is:

1. A downhole apparatus comprising:

a casing string;

a degradable plug positioned in the casing string to block flow therethrough;

a flow barrier positioned in the casing string below the degradable plug, the degradable plug and the flow barrier defining a buoyancy chamber therebetween; and a debris barrier positioned above the degradable plug, the debris barrier comprising:

a frangible disk configured to break into pieces and pass through the casing string upon removal of the plug from the casing string; and a stretchable connecting ring connected to the frangible disk and to the casing string, the debris barrier and degradable plug defining a fluid chamber containing a fluid therebetween.

2. The downhole apparatus of claim 1, the fluid in the fluid chamber comprising a degrading fluid.

3. The downhole apparatus of claim 2, further comprising a plug housing connected in the casing string, the degradable plug fixed in the plug housing.

4. The downhole apparatus of claim 2, further comprising a membrane positioned across an upper end of the degradable plug.

5. The downhole apparatus of claim 2, the stretchable ring comprising an elastomeric ring.

6. The downhole apparatus of claim 2, the stretchable ring configured to tear and disconnect the debris barrier from the casing string.

7. A downhole apparatus comprising:

an outer case connected at upper and lower ends in a casing string;

a degradable plug positioned in the outer case;

a flow barrier connected in the casing string below the degradable plug, the degradable plug and flow barrier defining a buoyancy chamber therebetween; and a debris barrier mounted in the outer case above the degradable plug, the debris barrier comprising a frangible disk and a flexible connecting ring connecting the frangible disk to the outer case, the debris barrier and degradable plug defining a fluid chamber therebetween.

8. The downhole apparatus of claim 7, further comprising:

a plug housing connected in the outer case, the plug housing and the outer case defining an annulus therebetween; and a rupture disk positioned in a port defined in the outer case, the port positioned to communicate fluid from the fluid chamber into the annulus, the plug housing having openings therethrough to communicate the fluid to the degradable plug, the flexible connecting ring configured to tear and disconnect the frangible disk from the outer case after the rupture disk ruptures.

9. The downhole apparatus of claim 8, the frangible disk configured to break into small fragments after the flexible connecting ring tears away from the outer case.

10. The downhole apparatus of claim 7, the flexible connecting ring comprising an elastomeric connecting ring.

11. The downhole apparatus of claim 7, the frangible disk comprising a dome-shaped frangible disk.

12. The downhole apparatus of claim 7, the frangible disk comprising an upward-facing concave disk.

13. The downhole apparatus of claim 7 further comprising an impermeable membrane stretched across upper and lower ends of the degradable plug.

14. A downhole apparatus comprising:

a casing string;

an outer case connected to and forming a part of the casing string;

a plug housing connected in the outer case;

a degradable plug fixed in the outer case and positioned to block flow therethrough; and a debris barrier connected in the casing string above the degradable plug, the debris barrier and degradable plug defining a fluid chamber containing a degrading fluid therebetween, the debris barrier comprising:

a flexible connecting ring; and a frangible disk connected to the flexible connecting ring.

15. The downhole apparatus of claim 14, further comprising a flow barrier connected in the casing string below the degradable plug, the degradable plug and flow barrier defining a buoyancy chamber therebetween.

16. The downhole apparatus of claim 14, the flexible connecting ring configured to tear and disconnect the frangible disk from the outer case as a result of fluid pressure acting on the frangible disk.

17. The downhole apparatus of claim 16, the outer case having a port communicated with an annulus defined by and between the plug housing and the outer case, the port having a rupture disk therein, the debris barrier configured to apply downward pressure to the fluid in the fluid chamber to rupture the rupture disk and urge the degrading fluid through the port.

18. The downhole apparatus of claim 14, the flexible connecting ring comprising an elastomeric connecting ring.

19. The downhole apparatus of claim 18, the frangible disk comprising a phenolic disk.

* * * * *